US005121902A

United States Patent [19]

Jalil et al.

[11] Patent Number: 5,121,902

[45] Date of Patent: Jun. 16, 1992

[54] APPARATUS FOR COOLING HOT ROLLED STEEL ROD USING A PLURALITY OF AIR AND WATER COOLED SECTIONS

[75] Inventors: Asjed A. Jalil, Holden; Charles H. Gage, Westborough; Kenneth Fournier, Worcester, all of Mass.

[73] Assignee: Morgan Construction Company, Worcester, Mass.

[21] Appl. No.: 342,628

[22] Filed: Apr. 19, 1989

Related U.S. Application Data

[63] Continuation of Ser. No. 161,357, Feb. 22, 1988, abandoned, which is a continuation of Ser. No. 658,658, Oct. 9, 1984, abandoned.

[51] Int. Cl.[5] ..... C21D 1/667

[52] U.S. Cl. ..... 266/106; 266/111; 266/112; 266/113; 148/655

[58] Field of Search ..... 266/106, 111, 112, 113; 148/12 B, 156

[56] References Cited

U.S. PATENT DOCUMENTS

| | | | |
|---|---|---|---|
| 3,940,967 | 3/1976 | Vittelli | 72/201 |
| 4,054,276 | 10/1977 | Wilson | 266/106 |
| 4,168,993 | 9/1979 | Wilson et al. | 148/12 B |
| 4,242,153 | 12/1980 | Vitelli et al. | 148/12 B |
| 4,362,040 | 12/1982 | Yamaguchi et al. | 72/201 |
| 4,375,884 | 3/1983 | Grotepass | 266/106 |
| 4,397,449 | 8/1983 | Kameda et al. | 266/106 |
| 4,448,401 | 5/1984 | Jalil et al. | 266/78 |

*Primary Examiner*—R. Dean
*Assistant Examiner*—Margery S. Phipps
*Attorney, Agent, or Firm*—Samuels, Gauthier & Stevens

[57] ABSTRACT

A conveyor defines a path along which hot rolled steel rod is transported in the form of overlapping mutually offset rings. Air nozzles are arranged beneath the conveyor path to direct air upwardly against the rings from underlying plenum chambers fed by motor driven fans. Additional water nozzles are arranged to apply water to the rings. Some of the thus applied water is vaporized by the heat of the rod, and the remainder of the water is drained through the air nozzles into the plenum chambers for subsequent removal.

9 Claims, 6 Drawing Sheets

APPARATUS FOR COOLING HOT ROLLED STEEL ROD USING A PLURALITY OF AIR AND WATER COOLED SECTIONS

This is a continuation of copending application Ser. No. 161,357 filed on Feb. 22, 1988, now abandoned, which is a continuation of copending application Ser. No. 658,658 filed on Oct. 9, 1984, now abandoned.

BACKGROUND OF THE INVENTION

1. Field of the Invention

This invention relates generally to the controlled cooling of hot rolled steel products such as rods and the like in direct sequence with the rolling operation in order to achieve predetermined metallurgical qualities 2. Description of the Prior Art The controlled cooling of hot rolled steel rod in direct sequence with the rolling thereof began approximately twenty years ago with the process described in U.S. Pat. No. 3,231,432 (McLean et al). This process involves hot-rolling the rod and thereafter directly coiling it onto an open conveyor in spread out ring form while the microstructure of the steel is still in a condition of highly uniform, relatively small austenite grain size. While moving along the conveyor, the rings are air cooled through allotropic transformation. This produces a "patented" microstructure, i.e., a microstructure sufficiently equivalent to that achieved by air or lead patenting so as to enable the rod to be subsequently processed to a finished product, as for example by being drawn into wire, without additional heat treatment.

In the earlier installations of this process, chain-type conveyors were employed. However, because of the tendency of the rings to undergo scratching as a result of their being dragged over stationary support rails located between the chains, and because of the non-uniform cooling which results from prolonged area contact with such rails, the use of chain-type conveyors has of late been largely discontinued in favor of roller conveyors of the type shown for example in U.S. Pat. No. 3,930,900 (Wilson). Here, the rings are transported over driven rollers, with air nozzles arranged between the rollers to blow cooling air upwardly through the rings.

Further improvements in uniformity of cooling and flexibility of operation have been achieved by arranging the air cooling nozzles directly under the conveyor rollers, as shown for example in U.S. Pat. No. 4,448,401 (Jalil et al).

The rod sizes that are processed in installations of the foregoing type typically range from 5–19 mm. in diameter For rods below about 9 mm. in diameter, air cooling has proven to be fast enough to achieve acceptable tensile strengths. However, for rods 9 mm. and above in diameter, air cooling rates are not sufficiently rapid, thus yielding tensile strengths which are below acceptable levels for certain applications.

Attempts have been made at achieving increased cooling rates by employing water as a cooling medium. See for example U.S. Pat. No. 4,395,022 (Paulus et al) which describes an apparatus for cooling hot rolled steel products, including rod, by immersion in a water bath. Cooling by water immersion has reportedly achieved somewhat accelerated cooling rates with improved tensiles for larger rod sizes. However, uniform results have been difficult to achieve, primarily because of the difficulty of maintaining optimum water chemistry. This problem is compounded by the need to continuously remove contaminants such as dirt, mill scale, etc. from the water bath.

As shown by U.S. Pat. No. 4,168,993 (Wilson et al), some work has been done with water sprays. The problem with these arrangements, however, is that certain conveyor zones are limited to cooling by a water spray application, whereas other conveyor zones are limited to cooling by air. If only air cooling is required, as for example when processing smaller diameter rods, then the water cooling zones must be shut down. Thus, as the rod moves along the conveyor, it experiences extended intervals (while moving through the inoperative water cooling zones) when no coolant is being applied. This seriously compromises the overall effectiveness of such processes.

Because of the foregoing problems, when rolling rod diameters of 9 mm. and above, most mills either draw wire to greater reductions, or use alloying elements to increase the hardenability of the steel, or resort to off-line lead or salt patenting heat treatments. The first of these alternatives yields mixed results, and the second and third alternatives significantly increase tonnage costs. In short, the prior art has failed to satisfactorily meet the demands of the industry when processing the larger rod sizes ranging from 9–19 mm. in diameter.

SUMMARY OF THE PRESENT INVENTION

A primary objective of the present invention is the provision of an improved cooling conveyor having successive zones adapted to continuously air cool the smaller rod sizes in a conventional manner, with at least some of the same zones being adapted to cool with water sprays or with water laden air when accelerated cooling of the larger rod sizes is required.

All conveyor zones have forced air cooling systems which include air nozzles underlying the path of ring travel over the conveyor rollers, and with air ducts connecting the air nozzles to motor driven fans. The accelerated cooling zones are additionally provided with water cooling systems, including water nozzles fed by appropriate piping. In one embodiment, the nozzles are arranged directly adjacent to the path of ring travel so as to spray water directly onto the rings, preferably from both above and below. In another embodiment, the water nozzles are arranged in the air ducts to spray water droplets into the forced air streams being generated by the motor driven fans, thereby producing water laden air which passes upwardly through the air nozzles for application to the rod rings.

When either of the above-described water cooling embodiments is in operation, a portion of the water being applied to the hot rod will be converted to steam. The steam is captured by removable hoods overlying the conveyor and removed therefrom by appropriate vents and ducting. The remainder of the water drains back downwardly through the air nozzles into the air ducts, where it is collected and removed for subsequent filtering and recirculation.

Thus it will be seen that the air ducts and nozzles serve the dual function of applying air to the rod rings, and/or draining away excess water, depending upon which mode of operation is selected. This total versatility makes it possible for the accelerated cooling zones of the conveyor to operate on the entire range of rod sizes, even when only air cooling is being employed.

DETAILED DESCRIPTION OF ILLUSTRATED EMBODIMENTS

Figure 1:
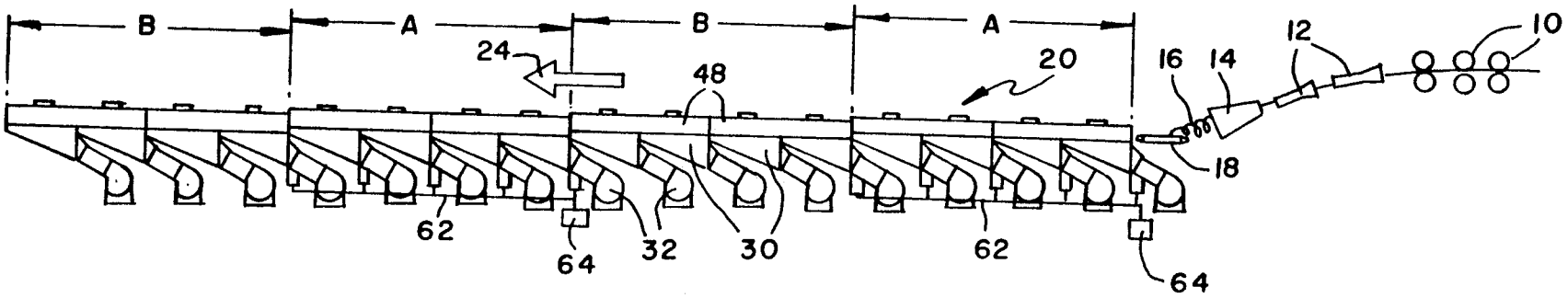
FIG. 1 is a somewhat schematic illustration, in side elevation, of a cooling installation in accordance with the present invention.
Figure 2:
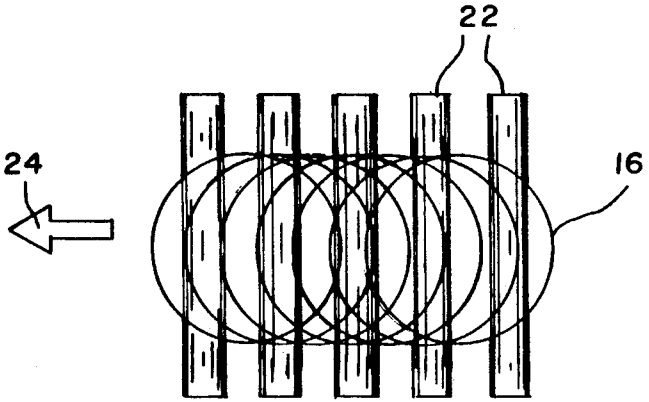
FIG. 2 is a partial plan view illustrating the offset overlapping relationship of the rings moving along the conveyor.

Referring initially to FIGS. 1 and 2, the last roll stands pairs of a conventional finishing block are diagrammatically shown at 10. Hot rolled steel rod emerges from the finishing block and is conveyed by means of water cooled delivery pipes 12 to a laying head 14. The laying head forms the rod into a continuous series of rings 16 which are received on a short conveyor belt 18. The belt 18 is driven at an appropriate speed which arranges the rings in an overlapping offset pattern as they move onto the cooling conveyor 20. Conveyor 20 has mutually spaced driven conveyor rollers 22 which propel the offset overlapping rings 16 in the direction indicated schematically by the arrow 24 in FIG. 2.

In the embodiment herein illustrated, the conveyor 20 is subdivided into sections A & B. Sections B are adapted to cool the rings in a conventional manner with forced air only, and thus may comprise any one of a number of known designs, an example of which is described in U.S. Pat. No. 4,448,401 (Jalil et al). However, the conveyor sections A have the multiple capability of applying air alone, or either water sprays or water laden air.

Figure 3:
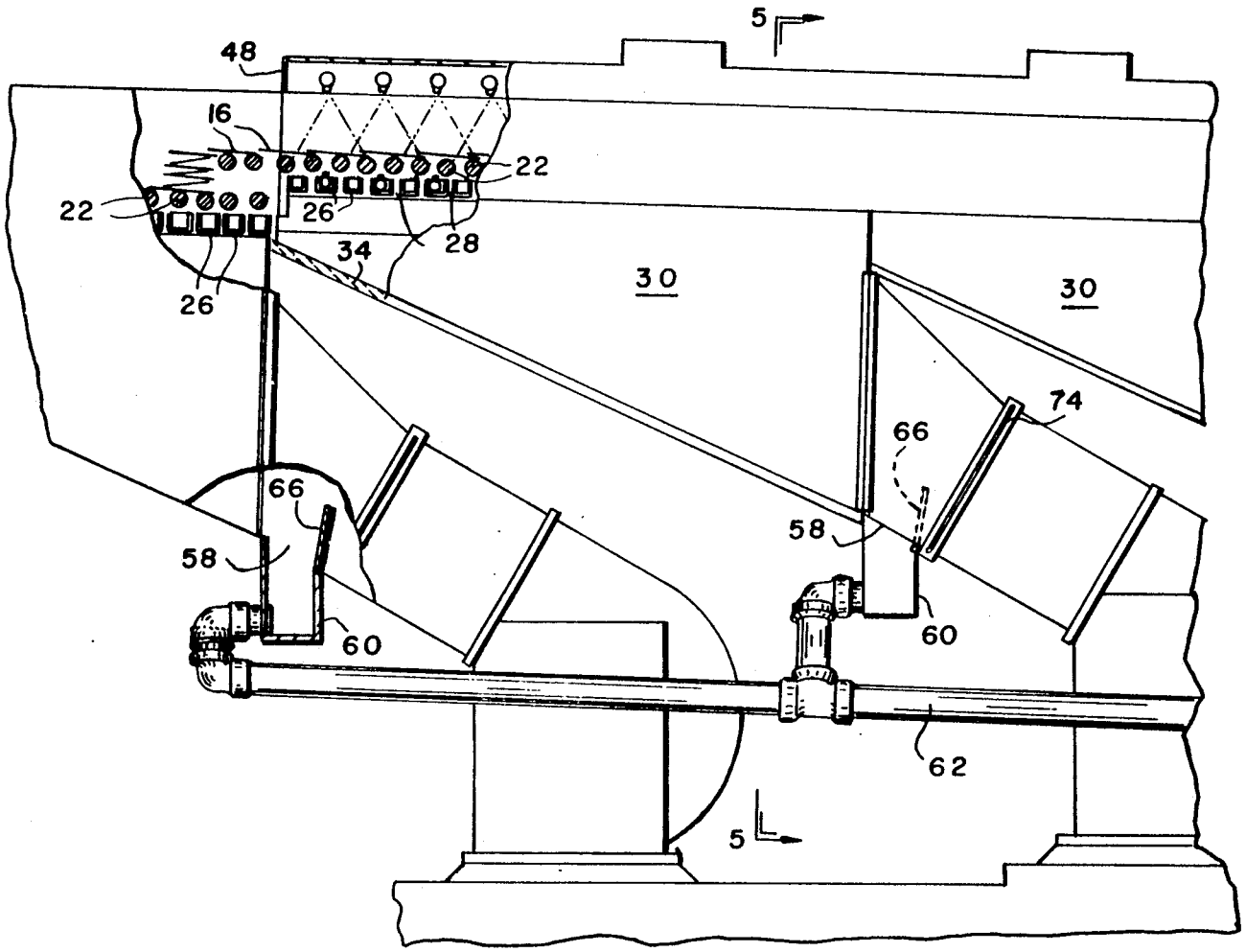
FIG. 3 is an enlarged side elevational view, with portions broken away, showing one embodiment of a conveyor section in accordance with the present invention, having both air and water cooling capabilities.
Figure 4:
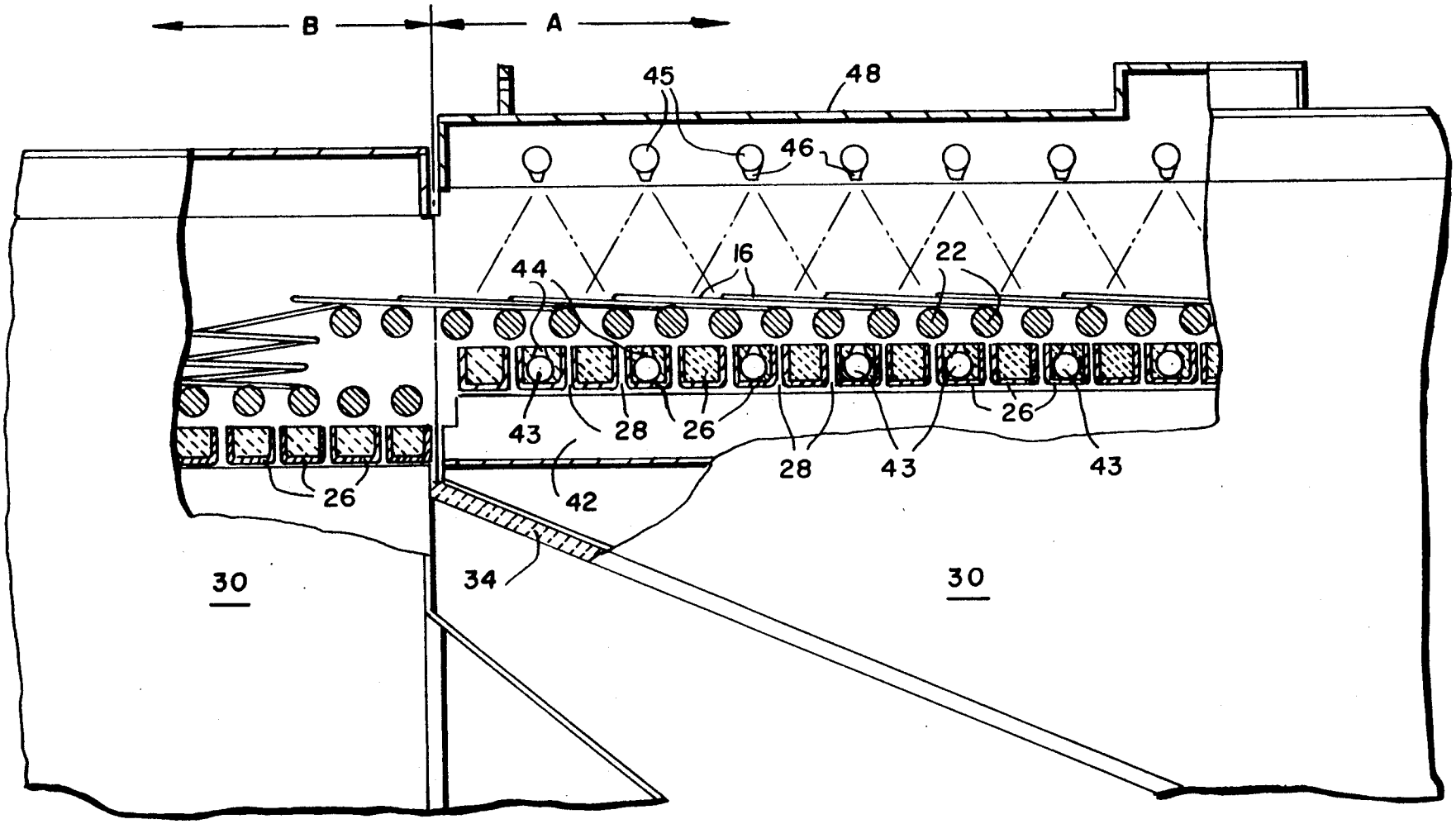
FIG. 4 is a further enlarged and partially broken away side elevational view of a portion of the conveyor shown in FIG. 3.
Figure 5:
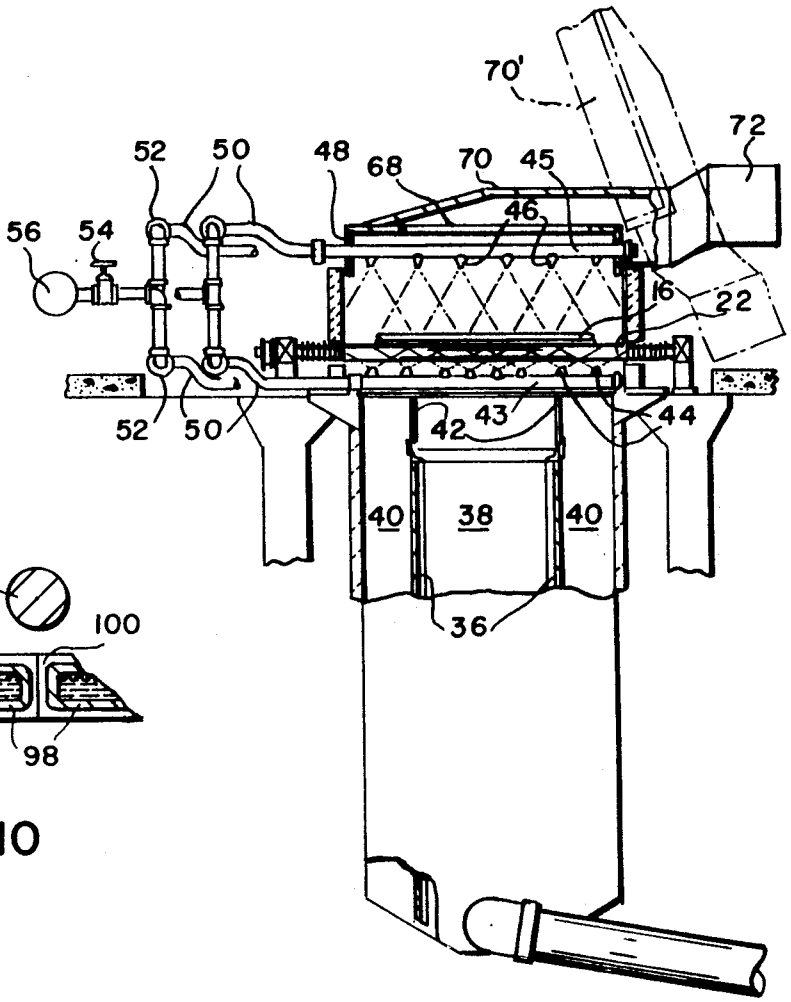
FIG. 5 is a cross-sectional view of the conveyor taken along line 5—5 of FIG. 3.

Referring additionally to FIGS. 3-5, one embodiment of a conveyor section A is shown wherein the driven conveyor rollers 22 overlie a conveyor deck made up of refractory filled channel members 26. The channel members 26 are spaced one from the other to provide "first" air nozzles 28 arranged beneath the path of travel of the rod rings 16 over the conveyor rollers. Preferably, the air nozzles 28 underlie the rollers 22 and extend across the entire conveyor width.

The air nozzles 28 communicate with any one of a number of underlying air ducts 30, each being supplied with forced air by a motor driven fan 32. The ducts are suitably insulated with refractory, each have a sloping bottom wall 34. Each duct is interiorly subdivided by partitions 36 (See FIG. 5) into a center chamber 38 and two side chambers 40. The output of the fan 32 may be selectively divided by baffles (not shown) so as to direct a greater proportion of cooling air into the side chambers 40 for application through the nozzles 28 at the sides of the conveyor where the density of ring overlap is greatest. Additionally, adjustable deflectors 42 are provided along the upper edges of the partitions 36 to further control the application of cooling air through the nozzles 28. The air nozzles 28, ducts 30 and air driven fans 32 are features common to both conveyor sections A and B.

Water supply pipes 43 extend through at least some of the refractory filled channel members 26 underlying certain of the spaces between the conveyor rollers 22. The water supply pipes 43 have upwardly directed "second" nozzles 44. Preferably, additional water supply pipes 45 are arranged over the conveyor rollers on cover sections 48. The supply pipes 45 carry additional downwardly directed second water nozzles 46. The water supply pipes 43, 45 are connected via flexible piping 50 to distribution headers 52 which in turn are connected via a shut off valve 54 to a main water header 56. The arrangement of the nozzles 44, 46 is preferably such that in comparison to the amount of water applied at the conveyor center, a greater amount of water is applied at the conveyor edges.

As can be best seen in FIG. 3, the sloping bottom wall 34 of each air duct 30 has a drain opening 58 leading to a small sump 60. The sumps are in turn connected by means of drain piping 62 to the collectors 64 shown in FIG. 1.

Flap valves 66 are associated with each of the drain openings 58. The valves may be adjusted manually by any convenient means (not shown) between open positions as shown in the drawings, and closed positions blocking the drain openings.

As shown in FIG. 5, at least some of the conveyor cover sections 48 have has a top opening 68 communicating with a steam vent 70 and a steam extraction duct 72. After first disconnecting the flexible piping 50, the cover sections may be pivoted to open positions indicated by broken lines at 70'.

In operation, the conveyor sections A and B can be operated to cool the rod rings with air only, with water sprays only, or with mist-like water laden air. When cooling with air only, the flap valves 66 and the water shut off valve 54 will be closed, the flexible piping 50 will be disconnected and the cover sections 48 raised to their open positions 70'. Thereafter, by operating the fans 32, air will be driven upwardly through the ducts 30 and first air nozzles 28 for application to the rod rings moving over the driven rollers 22.

When cooling with water only, the fans 32 are shut down and slide plates 74 (see FIG. 3) are manually inserted across the ducts 30 to safeguard the fans against exposure to moisture. The cover sections 48 are lowered into place and the flexible piping 50 is connected. Thereafter, with the flap valves 66 open, the main shut off valve 54 is opened to feed water to the second water nozzles 44,. 46. The water is applied from above and below the rings as a fine spray. Much of the water is converted to steam by the heat of the rod, and this steam is exhausted from the conveyor through the vents 70 and extraction ducts 72. The remainder of the water runs down through the first air nozzles 28 into the ducts 30. Gravity directs the water down the sloping duct bottoms 34 and through the drain openings 58 into the sumps 60, and from there through the drain piping 62 to the collectors 64. Although not illustrated in the drawings, it will be understood that water from the collectors 64 may be filtered and recirculated back to the main water header 56. It should also be understood that the temperature of the water being applied through nozzles 44 and 46 may be controlled, as by preheating, in order to achieve selected cooling rates for the rod rings being processed on the conveyor.

Figure 6:
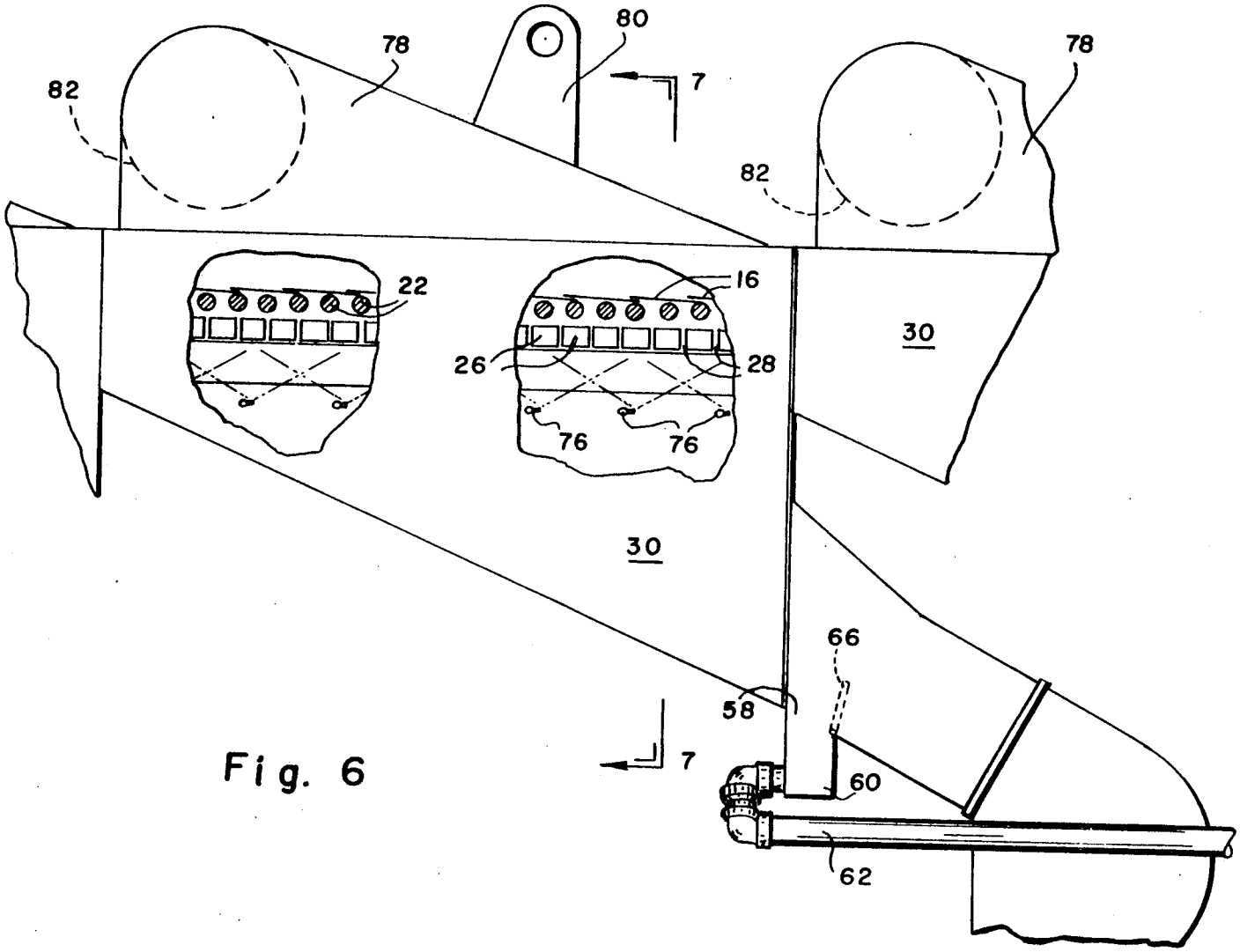
FIG. 6 is a side elevational view, with portions broken away, showing another embodiment of a conveyor section in accordance with the present invention having both air and water cooling capabilities.
Figure 8:
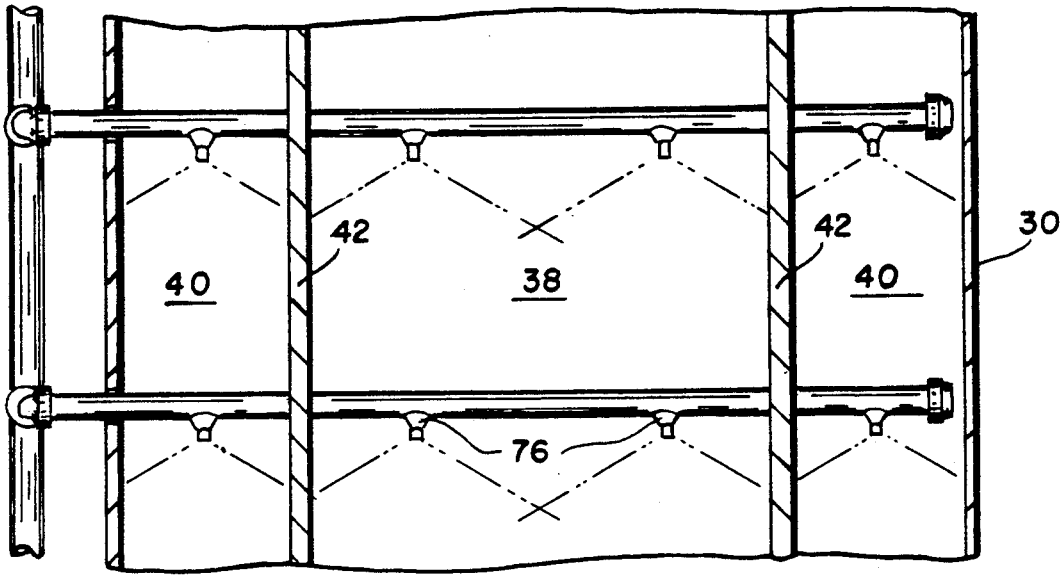
FIG. 8 is a horizontal sectional view taken along line 8—8 of FIG. 7 and showing one type of water nozzle arrangement.
Figure 7:
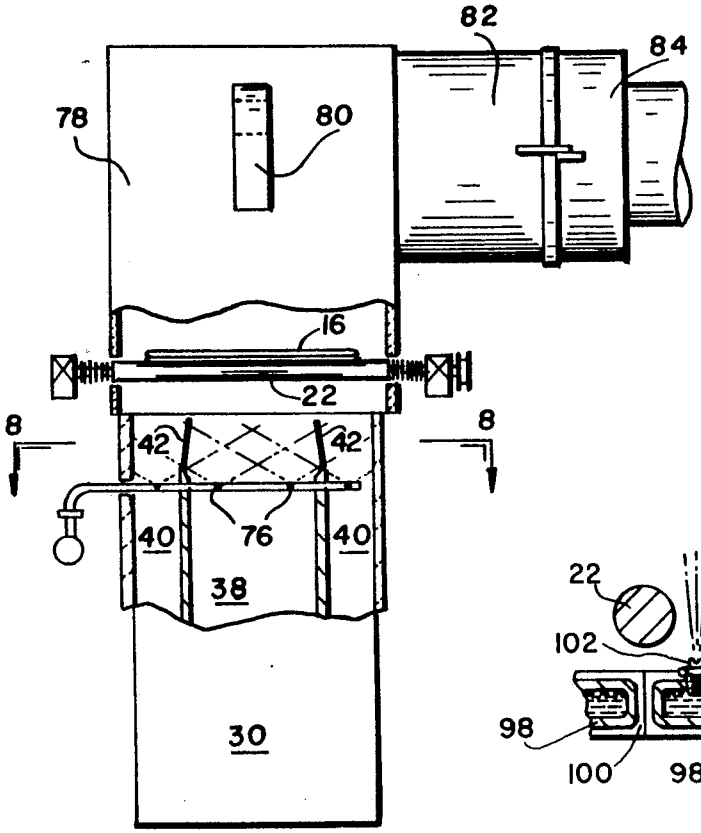
FIG. 7 is a cross-sectional view of the conveyor taken along line 7—7 of FIG. 6.

An alternate embodiment of a conveyor section A is shown in FIGS. 6–8. Those elements which are common to both embodiments have been designated by the same reference numerals. Here it will be seen that the "second" water nozzles 76 are located exclusively in the air duct 30. The cover sections 78 are removable by means of lifting eyes 80, and are detachably connected by means of lateral branch conduits 82 to steam exhaust ducts 84. The water nozzles 76 are arranged to direct a fine water spray into the air stream being generated by the fans 32. The resulting water laden air passes upwardly through the first nozzles 28 for application to the rod rings being carried along the conveyor by the driven rollers 22. Steam is vented from the cover sections 78 through the branch conduits 82 and communicating exhaust ducts 84, and excess water again drains back through the nozzles 28 into the air ducts 30 for removal as previously described. When operating with air only, the water nozzles 76 are shut down, the cover sections 78 are removed, and the flap valves 66 are closed.

Figure 9:
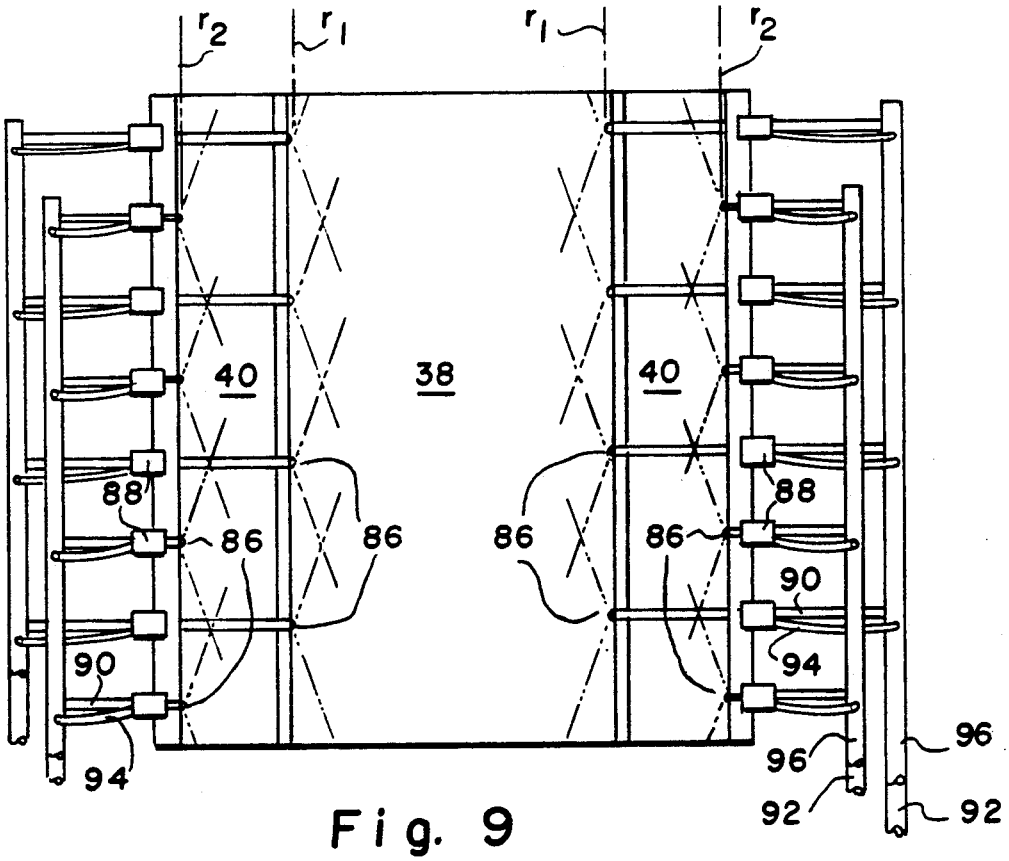
FIG. 9 is a view similar to FIG. 8 showing another water nozzle arrangement.

FIG. 9 shows a further modification of the embodiment illustrated in FIGS. 6–8. Here, the "second" nozzles 86 are again located exclusively in the air duct 30. The nozzles 86 are arrayed in multiple rows $r_1$, $r_2$. The rows $r_1$ are located in the center chamber 38 whereas the rows $r_2$ are located respectively in the side chambers 40. The nozzles 86 are fed by mixers 88 with water by one branch 90 connected to a water main 92, and with compressed air by another branch 94 connected to an air manifold 96. The nozzles 86 produce a fine mist which mixes more thoroughly with the air output of the fans 32.

Figure 10:
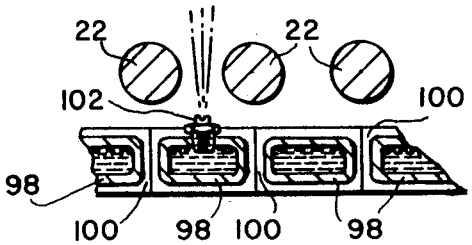

Still another embodiment of the invention is shown in FIG. 10 where the conveyor deck is comprised of a series of rectangular tubes 98 spaced as at 100 to define first air nozzles. Selected ones of the tubes are provided with a series of second water nozzles 102. Cooling water is circulated through the tubes 98, and the nozzles 102 spray that cooling water upwardly onto the rings being transported over the conveyor rollers 22. Here again, the first nozzles 100 allow excess water to drain back to the underlying air plenum (not shown).

Having thus described several embodiments of an apparatus in accordance with the present invention, the advantageous features thereof will now be appreciated by those skilled in the art. When processing the smaller diameter rods (below 9 mm.), conveyor sections A and B may be operated with cooling air only, in accordance with conventional practice. Under such circumstances, the conveyor cover sections are opened or removed to accommodate unrestricted upward flow of the cooling air through and around the overlapped rod rings moving along the conveyor. Since all of the conveyor sections are equipped with air cooling nozzles, ducts and fans, the application of forced air is substantially continuous along the entire conveyor length.

When larger diameter rods are being processed, more rapid cooling rates can be achieved by shifting over the operation of the conveyor sections A from the air cooling mode to one of the previously described water cooling modes. Each of the water cooling modes is characterized at least in part by an upward application of water sprays or water laden air. Because the overlapped rod rings are moving over the spaced conveyor rollers, this upward application is necessarily intermittent. This is believed to be beneficial in that it allows water applied to the hot rod surfaces to vaporize into steam and to move away from the rod surfaces before the next successive water application. Because the steam is not trapped against the rod surfaces, as would be the case with total immersion in a water bath, an insulating steam blanket is not formed, and thus more rapid cooling rates may be achieved.

It will be understood that the sequential arrangement of conveyor sections A and B can be varied to suit operating conditions. For example, it may be desirable to have several consecutive A sections at the beginning of the conveyor, or for that matter, to have all conveyor sections of the A type.

We claim:

1. For use with a conveyor defining a path leading through a longitudinally extending cooling zone and along which high temperature hot rolled steel rod is transported in the form of overlapping offset rings, apparatus for cooling said rod rings, comprising:

means for longitudinally subdividing said cooling zone into a succession of first and second sections;

first and second upwardly directed air nozzles arranged respectively in said first and second sections beneath said path;

air supply means including ducts communicating with said first and second air nozzles for causing a flow of cooling air to be emitted upwardly therefrom for application against the rod rings being transported along said path through said first and second sections;

water nozzles arranged in said second sections;

water supply means communicating with said water nozzles for causing a flow of cooling water to be emitted therefrom for application against the rod rings being transported along said path through said second sections, some of the thus applied water being converted into steam by the heat of the rod rings and the remainder of the thus applied water being returned via said second air nozzles to said ducts;

means for removing said steam from the vicinity of said path;

means for removing the thus returned water from said ducts; and valve means for controlling the flow of air from said air supply means through said first and second air nozzles as well as the flow of water from said water supply means through said water nozzles, the arrangement of said first and second sections being such that by appropriate adjustment of said valve means, the rod rings being transported along said path may be subjected to continuous cooling by a continuous application of air in each of said first and second sections, or by selected combination of air in said first sections and air, water and/or air-water mixtures in said second sections.

2. The apparatus of claim 1 wherein at least some of said water nozzles are arranged in said second sections beneath said path to emit water upwardly against the rod rings.

3. The apparatus of claim 2 wherein at least some of said water nozzles are arranged in said second sections above said path to emit water downwardly against the rod rings.

4. The apparatus of claims 1, 2 or 3 wherein the means for removing steam comprises covers in said second sections overlying said path, said covers having steam vents communicating therewith.

5. The apparatus of claim 3 wherein said means for removing steam comprises removable covers in said second sections overlying said path, with steam vents communicating with said covers, the water nozzles being located above said path and being supported by said covers.

6. The apparatus of claim 1 wherein said water nozzles are arranged in said ducts, and wherein the water emitted from said water nozzles is mixed with the flow of cooling air being emitted from said second air nozzles.

7. The apparatus of claim 1 wherein said conveyor has a plurality of successive mutually spaced driven rollers on which said rings are carried along said path through said cooling zone, with at least some of said water nozzles being arranged beneath the spaces between said rollers.

8. The apparatus of claim 1 wherein said water means for removing returned water comprises drain liens in communication via drain outlets with said ducts, said valve means being operative to close said drain outlets when said apparatus is applying only air to the rod rings.

9. The apparatus of claim 6 wherein said ducts are subdivided by internal partitions into center chambers underlying the center portion of said conveyor, and side chambers underlying the side portions of said conveyor, and wherein said water nozzles are arranged in multiple rows, some of said rows being arranged in said center chambers and others of said rows being arranged in said side chambers.

* * * * *